US007027007B2

(12) United States Patent
Hossein

(10) Patent No.: US 7,027,007 B2
(45) Date of Patent: Apr. 11, 2006

(54) ANTENNA MAST AND DEVICE FOR ADJUSTING THE ORIENTATION OF AN ANTENNA

(75) Inventor: Safakhah Hossein, Orsay (FR)

(73) Assignee: Bouygues Telecom, Boulogne Billancourt (FR)

( * ) Notice: Subject to any disclaimer, the term of this patent is extended or adjusted under 35 U.S.C. 154(b) by 0 days.

(21) Appl. No.: 10/399,379

(22) PCT Filed: Oct. 12, 2001

(86) PCT No.: PCT/FR01/03168

§ 371 (c)(1),
(2), (4) Date: Jul. 28, 2003

(87) PCT Pub. No.: WO02/33785

PCT Pub. Date: Apr. 25, 2002

(65) Prior Publication Data

US 2004/0027307 A1 Feb. 12, 2004

(30) Foreign Application Priority Data

Oct. 16, 2000 (FR) ..... 00 13217

(51) Int. Cl.
*H01Q 3/02* (2006.01)
*H01Q 1/12* (2006.01)

(52) U.S. Cl. ..... 343/890; 343/892

(58) Field of Classification Search ..... 343/890, 343/891, 892, 882, 874, 878, 880
See application file for complete search history.

(56) References Cited

U.S. PATENT DOCUMENTS

| | | | | |
|---|---|---|---|---|
| 4,442,435 | A * | 4/1984 | Kiryu et al. | 343/709 |
| 5,212,912 | A * | 5/1993 | Foissac | 52/40 |
| 5,533,304 | A * | 7/1996 | Noble | 52/40 |
| 6,310,582 | B1 * | 10/2001 | Uetake et al. | 343/765 |
| 6,342,870 | B1 * | 1/2002 | Mehrkens et al. | 343/891 |
| 6,480,172 | B1 * | 11/2002 | Sawyer | 343/890 |

* cited by examiner

*Primary Examiner*—Shih-Chao Chen
*Assistant Examiner*—Minh Dieu A
(74) *Attorney, Agent, or Firm*—Blakely Sokoloff Taylor & Zafman

(57) ABSTRACT

A support for at least two panel antennas constituting relay antennas in at least one cellular telecommunications network, the support comprising a mast (1) and means for fixing said two antennas to the mast (1), said means being suitable for allowing the orientation of said antennas to be adjusted in tilt and in azimuth, the support being characterized in that said fixing means comprise, for at least one antenna (2), means (21) that define for said antenna a pivot pin (31) that is eccentric relative to the axis of the mast (1) and such that pivoting the antenna (2) about said pin enables the azimuth orientation of the antenna to be modified.

19 Claims, 5 Drawing Sheets

ANTENNA MAST AND DEVICE FOR ADJUSTING THE ORIENTATION OF AN ANTENNA

The present patent application is a non-provisional application of International Application No. PCT/FR01/03168, filed Oct. 12, 2001.

GENERAL TECHNICAL FIELD

The present invention relates to fixing one or more relay antennas for cellular radio telecommunications networks on a mast.

The invention also relates to devices for adjusting the orientation of such an antenna on a mast to which it is fixed.

Relay antennas in a cellular telecommunications network are panel antennas mounted on masts which are installed on high sites, for example, in urban areas, on the roofs of buildings.

A general object of the invention is to propose improvements to the way in which such antennas are fixed and the way their orientation is adjusted.

SUMMARY OF THE INVENTION

The invention proposes various devices which can be used independently or in combination.

1) In particular, in a first aspect, the invention proposes a fixing device which enables a plurality of panel antennas to be fixed to the same mast, while enabling the tilt and azimuth orientation of each antenna to be adjusted independently.

In particular, the fixing device makes it possible to adjust the orientations of two juxtaposed panel antennas fixed to the same mast to be adjusted by said device, depending on the type of configuration desired:

- either to adjust the two antennas to different azimuths (in which came both antennas can be used for example in the same network);
- or else to adjust the two antennas so that they are substantially coplanar, thus enabling them to be used with the same orientation in azimuth but for two different networks (for example one could be DCS 1800 and the other could be UMTS), with the two antennas nevertheless remaining independent concerning their respective tilt adjustments.

The solution proposed for this purpose is a support for at least two panel antennas constituting relay antennas for one or more cellular telecommunications networks, the support comprising a fixing element such as a mast and means enabling said two antennas to be fixed to said fixing element, said means being suitable for allowing the orientation of said antennas to be adjusted in tilt and in azimuth, wherein for two antennas carried by said fixing element and disposed side by side, the support comprises fixing means allowing each of said two antennas to pivot about a respective one of two pivot pins, said fixing means being suitable for enabling the antennas to pivot from a configuration in which both antennas are close to each other and oriented in substantially the same azimuth direction and a configuration in which the two antennas are spaced apart from each other and are oriented in distinct azimuth directions.

In particular, in an advantageous embodiment, the fixing means comprise means which, in addition to enabling an antenna to pivot about a pin also allow it to tilt about a horizontal pin in order to adjust its tilt orientation.

2) Furthermore, the invention also provides a particularly advantageous adjustment system that is particularly simple to mount and that makes it possible to perform adjustments both in tilt and in azimuth without it being necessary to reserve a large amount of space around the mast to make it possible for interventions and maintenance to be performed at man height.

To this end, the invention provides a support for at least one antenna panel constituting a relay antenna in a cellular telecommunications network, the support comprising a fixing element and means enabling said antenna to be fixed to said element, said means comprising first link means which are fixed to the fixing element and on which the antenna is hinged to pivot about a horizontal tilt axis and second link means which are adjustable by a user to tilt the antenna about its horizontal axis, the support being characterized in that the second link means comprise at least one arm pivotally hinged at both ends, firstly to the fixing element or means that are fixed thereto, and secondly to the antenna or to means interposed between the antenna and said arms, the pivot pins of said arms being parallel to the tilt axis of the antenna, means enabling one and/or the other of the pivot pins to be adjusted in height relative to the mast or to the antenna.

Advantageously, these means comprise in particular an intermediate element presenting at least one slot in which said pin can slide.

In a particular preferred embodiment, said intermediate element has an adjustment screw extending parallel to said slot and co-operating with a complementary thread passing through the pin that is suitable for moving in said slot or a piece fixed thereto, and also through a complementary thread that is fixed relative to said intermediate element.

Furthermore, a support can be provided which is fixed to the fixing element by clamping, said fixing element being a mast on which there are hinged the means which define the tilt axis of the antenna and those which define the pivot axis of the link arm(s).

In particular, said support is advantageously a collar which is extended by a fixed arm having the antenna or a support carried by the antenna hinged to the end thereof to tilt about a horizontal axis.

Such a structure presents the advantage of enabling an antenna panel, and in particular a dual-band antenna, to be fixed to the mast via a single fixing point.

3) Furthermore, in another aspect, the invention provides a support structure which makes it possible simultaneously to stiffen the antenna and to control its back lobe.

According to the invention, this object is achieved by a support for at least one panel antenna which constitutes a relay antenna in a cellular telecommunications network, the support comprising a mast and means for fixing said antenna to the mast, said fixing means comprising a holding support on which the antenna is mounted, the support being characterized in that the holding support comprises at least one stiffener element and an element forming a metal reflector for the antenna, which reflector is interposed between the antenna and the stiffener element.

In particular it is advantageous for the stiffener element to be a channel section girder.

4) In yet another aspect, the invention provides a tool for adjusting the tilt of a panel type antenna fixed to a mast by fixing means which allow its orientation to be adjusted, the tool being characterized in that it comprises:

- a rigid support;
- a device suitable for enabling said support to be fixed to said fixing element; and
- dividers comprising two hinged arms mounted on said support.

Advantageously, the tool includes level-setting means suitable for offsetting the divider-forming means relative to the support.

It should be observed that the various solutions proposed by the invention have the advantage of being particularly simple and inexpensive.

Furthermore, from the point of view of appearance, the various proposed support solutions also have the advantage, due to their simplicity, of enabling antenna masts to meld in particularly well with their environment.

BRIEF DESCRIPTION OF THE FIGURES

Other characteristics and advantages of the invention appear further from the following description which is purely illustrative and non-limiting and which should be read with reference to the accompanying figures, in which.

DESCRIPTION OF VARIOUS EMBODIMENTS

A Single-mount Antenna

Figure 1:
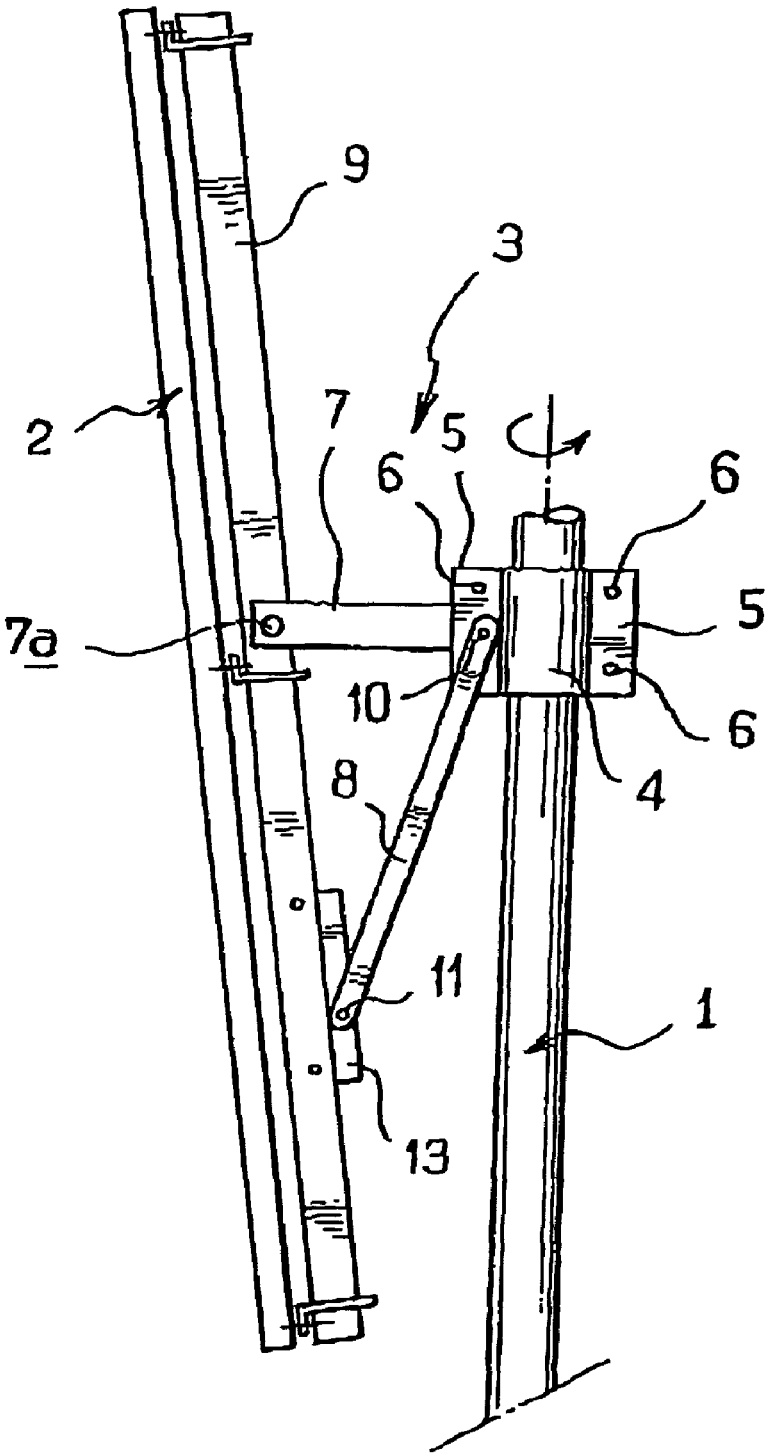
FIG. 1 is a diagrammatic aide view of an antenna support fixed to the mast at one point.

FIG. 1 shows a mast 1 which extends vertically and which has a panel type antenna 2 fixed thereon by means 3.

These fixing means 3 enable the antenna 2 to be fixed via a single point.

The means comprise a collar or sleeve 4 which is made up of two half-collars that are closed one on the other so as to be fixed by clamping on the mast 1.

Each of these two half-collars is generally semicylindrical in shape, being extended in its diametral plane and on both sides thereof by respective flat side flanges 5. The inside diameter of this semicylindrical shape corresponds substantially to the outside diameter of the mast 1. Screw means 6 carried by the flat flanges enable the two half-collars to be secured to each other and clamped onto the mast 1.

The collar 4 is connected to a girder 9 forming a stiffening element that carries the antenna 2. The link between the collar 4 and the girder 9 is implemented by means of:

firstly two arms 7 which are integral with the two elements that define the collar 4 and which extend therefrom, perpendicularly to the axis of the mast 1, the girder 9 being pivotally hinged to said arms 7 at the ends thereof about a horizontal pin 7*a*; and secondly by two arms 8 which are hinged at one end to pivot on those two flat flanges 5 that face the panel 9 so as to pivot about a pivot pin 10 which is perpendicular to said flanges; at their opposite ends, the two arms 8 are hinged to pivot about a pin 11 slidably mounted in slots 12 in a guide and adjustment piece 13 which is screwed to the panel 9.

Figure 2:
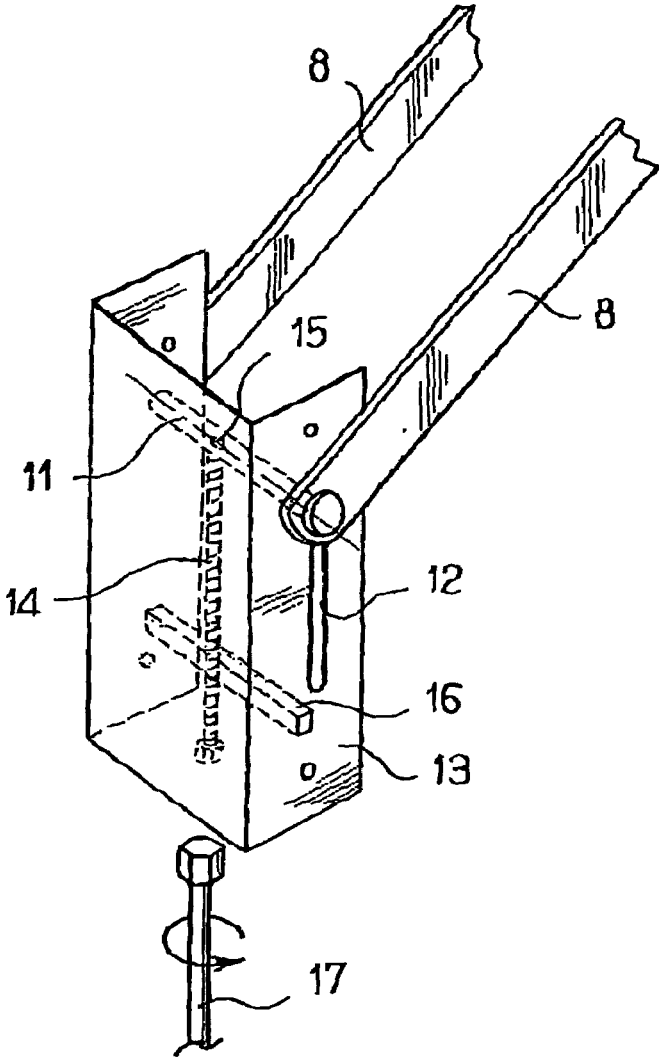
FIG. 2 is a diagrammatic perspective view showing a detail of the means for adjusting the tilt in the FIG. 1 support.

As shown in FIG. 2, this guide and adjustment piece 13 is in the form of an elongated channel section piece (made of folded sheet metal), which the slots 12 extending in register with each other vertically in each of two side flanges of said channel section piece.

A screw 14 extends inside said channel section piece and engages both with a complementary thread 15 formed through the pin 11 and with a complementary thread in an element 16 that is fitted to the inside of said channel section piece above or below the slots 12.

Figure 3A:
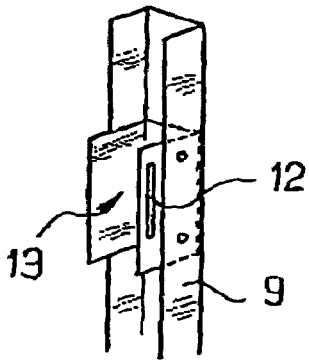
FIGS. 3*a* and 3*b* show two possible variants for mounting the adjustment means shown in FIG. 2.
Figure 3B:
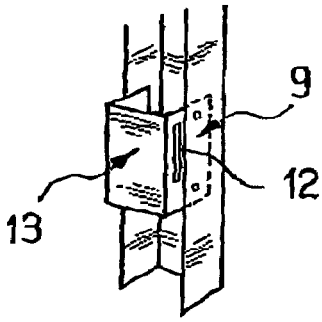

FIGS. 3*a* and 3*b* show two possible configurations for fixing the piece 13 to the girder 9 constituting a stiffener, which girder is in the form of a channel section complementary to that of the piece 13. In the configuration of FIG. 3*a,* the piece 13 is engaged inside the girder 9 with its web inside the girder; in the configuration shown in FIG. 3*b*, the piece 13 is placed the other way round so that its web lies outside the girder 9. In both configurations, the slots 12 are disengaged, lying outside the girder 9. The two pieces 13 and 9 are fixed together by screws or by welding.

Such a fixing structure has the advantage of being compact in the vicinity of the mast 1.

It allows adjustment to take place both in terms of tilt and in terms or azimuth and verticality.

For adjustment in azimuth and for vertical adjustment it suffices to loosen the screw means 6 and turn the collar 4 around the mast 1 or else raise or lower the collar.

To make a tilt adjustment, the technician can turn the adjustment screw 14 from below so as to cause the pin 11 to move up or down in the slots 12, thereby tilting the panel 9 and the antenna 2 in one direction or the other.

It should also be observed that the stiffener-forming girder structures serve not only to hold antennas well above the points at which they are fixed to masts, but they also have the advantage of allowing reflector elements to be included immediately behind the antennas, thereby giving good control over their back lobes.

Figure 4:
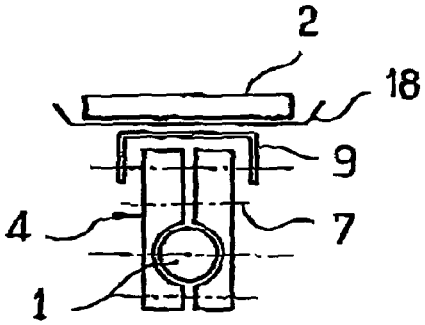
FIG. 4 is a diagrammatic section view of a possible mount for an antenna.

This is shown in FIG. 4 where there can be seen a metal reflector element 18 interposed between the girder 9 and the antenna 2.

Universal Fixing

Figure 5:
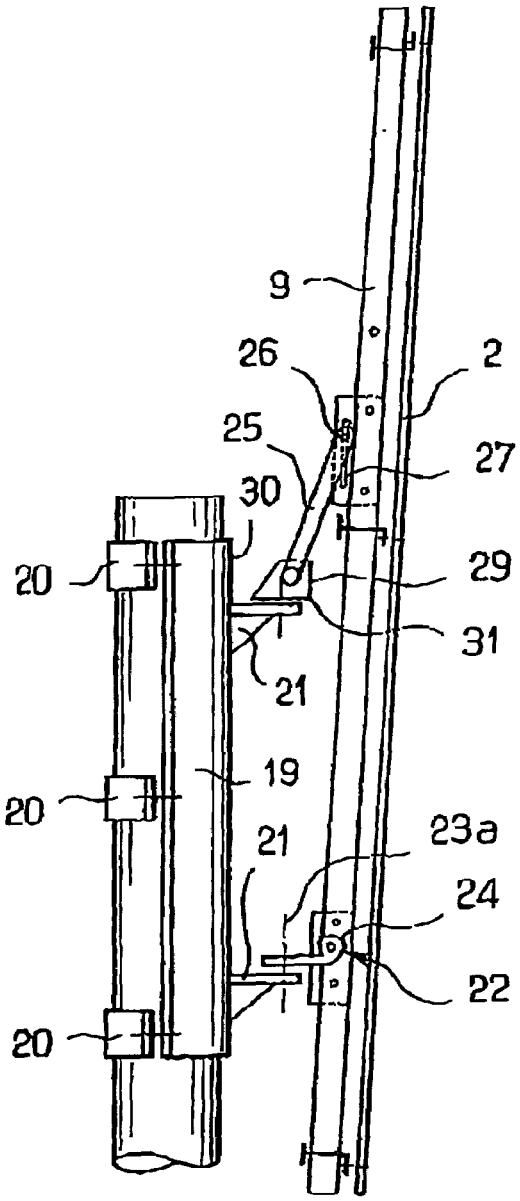
FIG. 5 is a diagrammatic view analogous to the view of FIG. 1 showing another antenna support.
Figure 6:
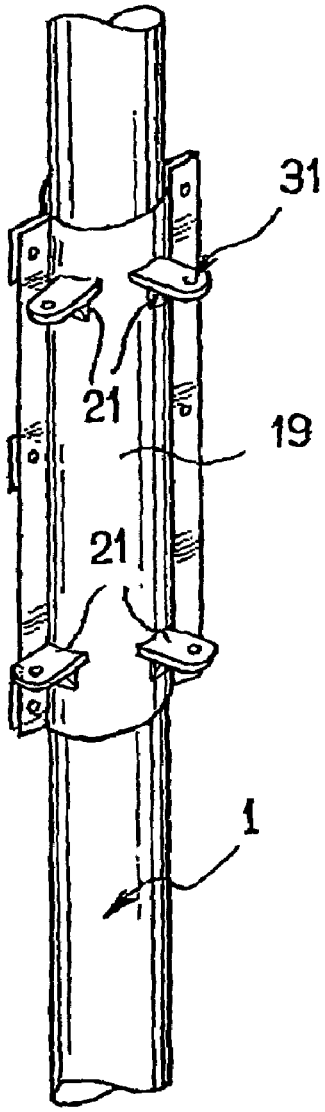
FIG. 6 is a diagrammatic perspective view showing a portion of the means constituting the support of FIG. 5.

FIGS. 5 and 6 show another structure. In this embodiment, the collar 4 is longer than in the variant shown in FIG. 1 but has only a single fixed point and it is constituted by a half-cylinder 19 which in fixed by being clamped to the mast 1 by three half-collars 20 which are distributed along the height of the collar and which close onto said half-cylinder 19.

The half-cylinder 19 carries tabs 21 which extend radially therefrom and which constitute supports on which various girders 9 each carrying a respective antenna can be pivotally hinged about vertical pins.

More precisely, in the example shown in FIGS. 5 and 6, the half-cylinder 19 carries two pairs of tabs 21 extending radially and angularly separated by 120° from each other, the two tabs 21 in each pair being disposed vertically one above the other, each pair of tabs 21 carrying a respective stiffener-forming girder 9 and antenna 2.

The girder 9 associated with a pair of tabs 21 has its bottom portion fixed to the lower tab in said pair by means of a hinge 22 which serves firstly to allow the girder to pivot about a vertical pin 23*a* and which also allows said girder 9 to pivot about a horizontal pin 24 to which said girder is hinged.

The girder 9 is also fixed to the other tab of said pair via fixing means which comprise means analogous to the arms 8, the pins 10 and 11, and the guide and adjustment piece 13 of the structure of FIG. 1, these means being constituted in this case by arms 25 mounted at one end to pivot about a horizontal pin 26 slidably received in slots 27 of a guide and adjustment piece 28 and also pivotally hinged at their opposite ends to a link piece 29 about a horizontal pin 30.

The link piece 29 is itself pivotally mounted on the above-specified tab 21 about a vertical pin 31.

Figure 7A:
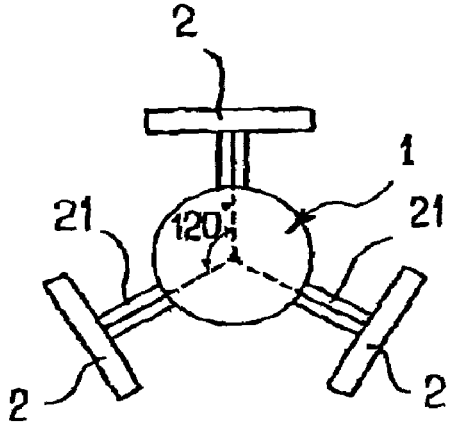
FIGS. 7*a* and 7*b* show two distinct configurations which can be implemented using two antennas mounted on a support of the type shown in FIGS. 5 and 6.
Figure 7B:
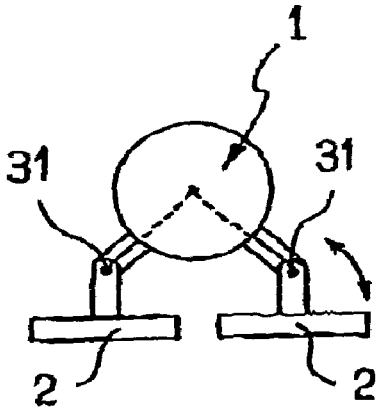

This makes it possible to give two juxtaposed antennas configurations that are as different as those shown in FIGS. 7*a* and 7*b*.

In FIG. 7*a*, two antennas 2*a* and 2*b* mounted on a common mast 1 and placed beside each other are used for covering two different azimuth angles, for example in the same network.

In FIG. 7*b*, the same two antennas have been pivoted about their pivot pins 31 so as to be disposed in coplanar manner, thus making it possible to use them on a single mast in order to cover the same azimuth direction for two different networks.

In both cases, orientation is adjusted, particularly in terms of tilt angle and in terms of vertical position in the same manner as for the structure described with reference to FIG. 1.

It will thus be understood that this structure likewise presents the advantage of being compact.

In addition, one of the advantages of a configuration in which orientation is adjusted by means of an arm sliding in slots as shown either with reference to FIGS. 1 to 4 or with reference to FIGS. 5 to 7*a*, 7*b* lies in the way it is possible to adjust antenna orientation without it being necessary to gain access to the mast from behind the panel as is the case in the prior art.

Orientation can be adjusted by turning the adjustment screw 14 which extends in the piece in which the guide slots are provided. For the configuration shown in FIG. 2, access to this adjustment screw is specifically from beneath the antenna.

Figure 8B:
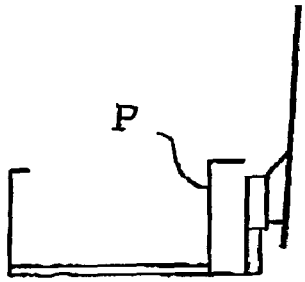
FIGS. 8*a* and 8*b* show two possible mounts using a support of the type described with reference to FIGS. 5 and 6.
Figure 8A:
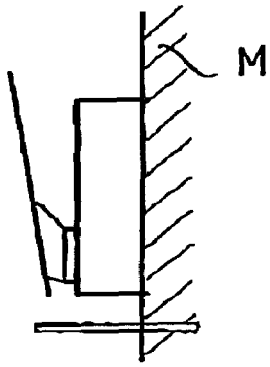

It should be observed that it is possible to use such a configuration when one or more antennas are fixed on a wall M (see FIG. 8*a*), which wall can constitute a fixing element instead of using a mast, or when a mast is used or a fixing element is placed on the other side of a safety barrier P (cf. FIG. 8*b*), the proposed configuration having the advantage or enabling orientation to be adjusted easily even under the above-specified circumstances.

Figure 9:
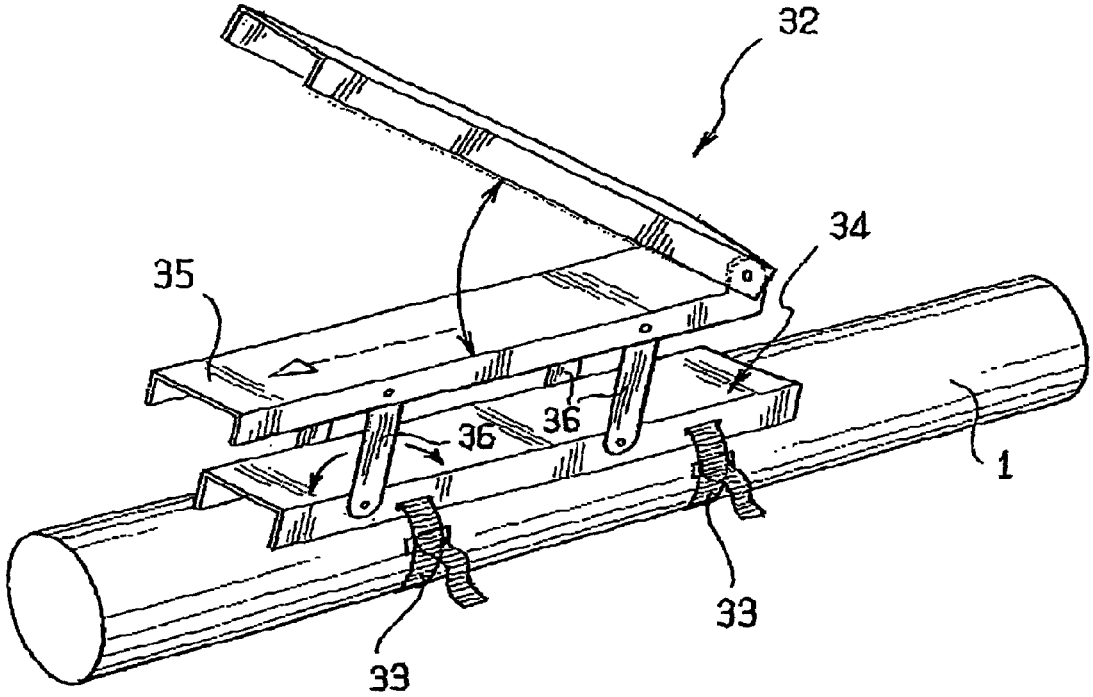
FIG. 9 is a perspective view of a tilt angle adjusting tool constituting one possible embodiment.

FIG. 9 is a perspective view of a protractor jig 32 for adjusting tilt in an antenna fixing system. The jig comprises a rigid support 34 fixed to the mast 1 by a fastener 33 constituted in this case by straps, but which could equally well be constituted by magnets, for example. The support 34 is connected to a divider arm 25 via parallel arms 36 for co-operating with the support 34 and the arm 35 to constitute a parallelogram linkage. An arm 37 is pivoted to the arm 35 so as to define angle-measuring dividers.

Graduations can be provided to enable a user to measure the angle between the divider arms.

When a user seeks to adjust or measure the angle of tilt of a panel antenna, the jig should be fitted to the mast, the arms extended to the appropriate level, and the dividers opened until the outer arm lies adjacent to the stiffener. The inclination of the antenna can then be measured directly by reading the angle to which the dividers have been opened.

The invention claimed is:

1. A support for at least two panel antennae constituting relay antennas for one or more cellular telecommunications networks, the support comprising a fixing element such as a mast (1) and means enabling said two antennas to be fixed to said fixing element, said means being suitable for allowing the orientation of said antennas to be adjusted in tilt and in azimuth, the support being characterized in that for two antennae (2) carried by said fixing element (1) and disposed side by side, it comprises fixing means allowing each of said two antennas (2) to pivot about a respective one of two pivot pins (31), said fixing means being suitable for enabling the antennas (2) to pivot from a configuration in which both antennas are close to each other and oriented in substantially the same azimuth direction and a configuration in which the two antennas are spaced apart from each other and are oriented in distinct azimuth directions.

2. A support according to claim 1, wherein the fixing means comprise means (22, 25, 26, 27) which, in addition to enabling an antenna to pivot about a pin (21) also allow it to tilt about a horizontal pin (24) in order to adjust its tilt orientation.

3. A support according to either preceding claim, wherein an eccentric pivot pin (31) is a vertical pin.

4. A support according to claim 3, further comprising a support which is clamped onto the fixing element (1) and which carries at least one pair of tabs (21) extending one above the other substantially perpendicularly to the axis of the mast (1) and defining supports for an eccentric pivot axis of an antenna.

5. A support according to claim 4, wherein the support comprises a plurality of such pairs of tabs (21).

6. A support for at least one antenna panel constituting a relay antenna in a cellular telecommunications network, the support comprising a fixing element (1) and means enabling said antenna to be fixed to said element (1), said means comprising first link means which are fixed to the fixing element (1) and on which the antenna is hinged to pivot about a horizontal tilt axis and second link means which are adjustable by a user to tilt the antenna about its horizontal axis, the support being characterized in that the second link means comprise at least one arm (8) pivotally hinged at both ends by pivot pins, firstly to the fixing element (1) or to a first intermediate element that is fixed thereto, and secondly to the antenna or to a second intermediate element interposed between the antenna and said arms, the pivot pins (10, 11) of said arms (8) being parallel to the tilt axis of the antenna, adjusting means enabling at least one of the pivot pins to be adjusted in height relative to the fixing element (1) or to the antenna.

7. A support according to claim 6, wherein said adjusting means include a third intermediate element (13) having at least one slot (12) in which one of the pivot pins can slide.

8. A support according to claim 7, wherein said third intermediate element (13) has an adjustment screw (14) extending parallel to said slot (12) and co-operating with a complementary thread passing through the pin that is suitable for moving in said slot or a piece fixed thereto, and also through a complementary thread fixed relative to said intermediate element.

9. A support according to claim 7 or claim 8, wherein the third intermediate element (13) is a piece fitted on an antenna or on a support carrying the antenna.

10. A support according to claim 9, wherein said piece is a channel section piece received in another piece (9) of complementary shape which constitutes a support carried by the antenna.

11. A support according to claim 10, further comprising a support (4) clamped onto the fixing element (1), said fixing element being a mast (1) on which there are hinged the means which define the tilt axis of the antenna and the means which define the pivot axis of the link arm(s).

12. A support according to claim 11, wherein support (4) is a collar which is extended by at least one fixed arm (7) having one end hinged to the antenna or to a support carrying the antenna allowing it to tilt about a horizontal axis.

13. A support according to claim 12, wherein said arm is perpendicular to the axis of said mast (1).

14. A support for at least one panel antenna which constitutes a relay antenna in a cellular telecommunication network, the support comprising a mast (1) and means for fixing said antenna to the mast (1), said fixing means comprising a holding support on which the antenna is mounted, wherein the holding support comprises at least one stiffener element (9) and an element (18) forming a metal reflector for the antenna, which reflector is interposed between the antenna and the stiffener element, wherein the stiffener element carries the antenna.

15. A support according to claim 14, wherein the stiffener element (9) is a channel section girder.

16. An apparatus comprising:

a tool for adjusting the tilt of a panel type antenna fixed to a fixing element such as a mast (1) by fixing means which enable its orientation to be adjusted, the tool including:

a rigid support (34);

a device (33) suitable for enabling said support to be fixed to said fixing element (1); and dividers comprising two hinged arms (35, 37) mounted on said support.

17. A tool according to claim 16, wherein the fixing means comprise strap means (33).

18. A tool according to claim 16, wherein the fixing means comprise magnet means.

19. A tool according to any one of claims 16 to 18, wherein it includes level-setting means (36) suitable for offsetting the divider-forming means relative to the support.

* * * * *